US006315645B1

(12) United States Patent
Zhang et al.

(10) Patent No.: US 6,315,645 B1
(45) Date of Patent: Nov. 13, 2001

(54) PATTERNED POLISHING PAD FOR USE IN CHEMICAL MECHANICAL POLISHING OF SEMICONDUCTOR WAFERS

(75) Inventors: Liming Zhang, Sunnyvale; Milind Ganesh Weling, San Jose, both of CA (US)

(73) Assignee: VLSI Technology, Inc., San Jose, CA (US)

( * ) Notice: Subject to any disclaimer, the term of this patent is extended or adjusted under 35 U.S.C. 154(b) by 0 days.

(21) Appl. No.: 09/291,788

(22) Filed: Apr. 14, 1999

(51) Int. Cl.[7] ..... B24B 7/04

(52) U.S. Cl. ..... 451/65; 451/66; 451/288; 451/290; 451/309; 451/527; 451/529; 451/537; 451/550

(58) Field of Search ..... 451/41, 57, 59, 451/63, 65, 66, 287, 288, 289, 290, 296, 309, 461, 527, 528, 529, 530, 534, 537, 550

(56) References Cited

U.S. PATENT DOCUMENTS 5,389,032 * 2/1995 Beardsley ..... 451/359
5,489,233 * 2/1996 Cook et al. ..... 451/41
5,558,563 * 9/1996 Cote et al. ..... 451/41
5,609,517 * 3/1997 Lofaro ..... 451/529
5,919,082 * 7/1999 Walker et al. ..... 451/41

* cited by examiner

*Primary Examiner*—Timothy V. Eley
(74) *Attorney, Agent, or Firm*—Wagner, Murabito & Hao LLP

(57) ABSTRACT

A patterned polishing pad adapted for use in a wafer polishing machine. The patterned polishing pad has a polishing surface adapted to contact frictionally a semiconductor wafer being polished in a chemical mechanical polishing machine. The polishing surface has a first region and a second region. The first region is adapted to contact frictionally the wafer and achieve a first process effect. The second region is adapted to contact frictionally the wafer and achieve a second process effect. The surface of the second region extends a predetermined protrusion amount above the polishing surface with respect to the surface of the first region. In so doing, the wafer polishing machine achieves a customized process effect by moving the wafer frictionally against the first region with a down force operable for compressing the protrusion amount of the second region, and moving the wafer frictionally against the second region wherein the protrusion amount prevents the wafer from effectively contacting the first region.

16 Claims, 9 Drawing Sheets

PATTERNED POLISHING PAD FOR USE IN CHEMICAL MECHANICAL POLISHING OF SEMICONDUCTOR WAFERS

TECHNICAL FIELD

The field of the present invention pertains to semiconductor fabrication processing. More particularly, the present invention relates to a system for utilizing patterned polishing pads for selective process performance during polishing of a semiconductor wafer in a chemical mechanical polishing (CMP) machine.

BACKGROUND ART

Most of the power and usefulness of today's IC (integrated circuit) devices can be attributed to the increasing levels of integration. More and more components (resistors, diodes, transistors, and the like) are continually being integrated into the underlying chip, or IC. The starting material for typical ICs is very high purity silicon. The material is grown as a single crystal. It takes the shape of a solid cylinder. This crystal is then sawed (like a loaf of bread) to produce wafers typically 10 to 30 cm in diameter and 250 microns thick.

The geometry of the features of the IC components is commonly defined photographically through a process known as photolithography. Very fine surface geometries can be reproduced accurately by this technique. The photolithography process is used to define component regions and build up components one layer on top of another. Complex ICs can often have many different built up layers, each layer having components, each layer having differing interconnections, and each layer stacked on top of the previous layer. The resulting topography of these complex IC's often resembles familiar terrestrial "mountain ranges," with many "hills" and "valleys" as the IC components are built up on the underlying surface of the silicon wafer.

In the photolithography process, a mask image, or pattern, defining the various components is focused onto a photosensitive layer, typically using ultraviolet light. The image is focused onto the surface using the optical means of the photolithography tool and is imprinted into the photosensitive layer. To build ever smaller features, increasingly fine images must be focused onto the surface of the photosensitive layer, e.g. optical resolution must increase. As optical resolution increases, the depth of focus of the mask image correspondingly narrows. This is due to the narrow range in depth of focus imposed by the high numerical aperture lenses in the photolithography tool. This narrowing depth of focus is often the limiting factor in the degree of resolution obtainable and, thus, the smallest components obtainable using the photolithography tool. The extreme topography of complex ICs, the "hills" and "valleys," exaggerate the effects of decreasing depth of focus. Thus, in order properly to focus the mask image defining sub-micron geometries onto the photosensitive layer, a precisely flat surface is desired. The precisely flat (e.g. fully planarized) surface will allow for extremely small depths of focus and, in turn, allow the definition and subsequent fabrication of extremely small components.

Chemical-mechanical polishing (CMP) is the preferred method of obtaining full planarization of a wafer. It involves removing a sacrificial layer of dielectric material using mechanical contact between the wafer and a moving polishing pad saturated with slurry. CMP flattens out height differences since high areas of topography (hills) are removed faster than areas of low topography (valleys). CMP is the only technique with the capability of smoothing out topography over millimeter scale planarization distances leading to maximum angles of much less than one degree after polishing.

Prior Art FIG. 1A shows a top view of a CMP machine 100, and Prior Art FIG. 1B shows a side section view of the CMP machine 100 taken through line BB of Prior Art FIG. 1A. CMP machine 100 is fed wafers to be polished. CMP machine 100 picks up the wafers with an arm 101 and places them onto a rotating polishing pad 102. Polishing pad 102 is made of a resilient material and is often textured, often with a plurality of predetermined groves, to aid the polishing process. Polishing pad 102 rotates on a platen 104, or turn table, located beneath polishing pad 102, at a predetermined speed. A wafer 105 is held in place on polishing pad 102 and arm 101. The lower surface of wafer 105 (e.g., the surface including fabricated features, often referred to as the front surface) rests against polishing pad 102. The upper surface of wafer 105 is against the lower surface of a wafer carrier 106 of arm 101. As polishing pad 102 rotates, arm 101 rotates wafer 105 at a predetermined rate. Arm 101 forces wafer 105 into polishing pad 102 with a predetermined amount of down force. CMP machine 100 also includes a slurry dispense arm 107 extending across the radius of polishing pad 102. Slurry dispense arm 107 dispenses a flow of slurry onto polishing pad 102.

Prior Art FIG. 1C shows a close-up view of wafer 105, wafer carrier 106, and polishing pad 102. As described above, wafer 105 is frictionally moved against the surface of polishing pad 102 of the rotating action of wafer carrier 106 and the rotating action of polishing pad 102. Wafer 105 is held in place beneath wafer carrier 106 by a carrier ring 110.

CMP is the preferred method of obtaining full wafer planarization, as described above, and is currently the only technique capable of over millimeter scale planarization after polishing. Hence, CMP is increasingly being used for planarizing dielectrics and other layers, particularly for applications using 0.35 $\mu$m and smaller semiconductor fabrication process technologies. Such applications include, for example, using CMP to planarize the trench oxide fill for a shallow trench isolation process.

As applications for CMP continue to increase, the specific CMP performance requirements for the individual process steps demand a specific set of process conditions and consumables (e.g., polishing slurry, polishing agents, and the like). Additionally, as semiconductor fabrication technology advances, many process requirements (such as global planarity, non-uniformity, edge exclusion, and the like) become increasingly stringent. These conditions often require unique optimization of process conditions. For example, CMP performance requirements are even more stringent with sub-0.25 $\mu$m semiconductor fabrication process technologies. The narrowing depth of focus at such resolutions requires optimal planarization performance from the CMP process.

One method of optimizing the CMP process for the differing devices is to have a uniquely optimized CMP machine for each particular device being fabricated. With individual, uniquely optimized CMP machines, the variables of the CMP process can be finely tuned for the requirements of the particular device being fabricated. Wafers containing devices of one type are thereby uniquely polished in relation to wafers containing devices of another type.

It is possible to use multiple individually tailored CMP machines or even a single CMP machine with multiple individually tailored polishing platens. Such machines, however, are not practical. The capital equipment costs, wafer throughput, fabrication facility floor space requirements, and operator training expenses of such machines each tends to outweigh the achievable benefits.

Thus, what is required is a system which can be readily optimized for differing CMP process requirements. The required system should be readily tunable for differing devices being polished. The required system should be tailorable, depending upon the requirements of the particular devices being polished, without adversely impacting wafer throughput. Additionally, the required system should have minimal added capital equipment costs, should not require increased fabrication facility floor space, or adversely impact operator training expenses. The present invention provides a novel solution to the above requirements.

DISCLOSURE OF THE INVENTION

The present invention comprises a customized polishing pad for use in a wafer polishing machine. The present invention provides a readily optimized system for differing CMP process requirements. The system of the present invention is readily tunable for each differing device being polished in the CMP process. The system of the present invention is tailorable, depending upon the requirements of a particular device being polished, without adversely impacting CMP process wafer throughput. Additionally, the system of the present invention has minimal added capital equipment costs, does not require increased fabrication facility floor space, and does not adversely impact operator training expenses.

In one embodiment, the present invention is implemented as a patterned polishing pad adapted for use in a wafer polishing machine. The patterned polishing pad has a polishing surface adapted to contact frictionally a semiconductor wafer being polished in a chemical mechanical polishing machine. The polishing surface has a relatively firm, less compressible first region (e.g., a hard region) and a relatively soft, more compressible second region (e.g., a soft region). The hard region is adapted to contact frictionally the wafer and achieve a "hard" process effect (e.g., removing layer material from the surface of a wafer) by way of its firmness against the wafer's surface. The soft region is adapted to contact frictionally the wafer and achieve a "soft" process effect (e.g., buffing the surface of the wafer) by way of its relative softness against the wafer's surface.

The surface of the soft region extends a predetermined protrusion amount above the polishing surface with respect to the surface of the hard region. In so doing, the wafer polishing machine achieves a customized process effect by moving the wafer frictionally against the hard region with a down force operable for compressing the protrusion amount of the soft region such that the surface of the wafer comes within direct contact with a hard region, and moving the wafer frictionally against the second region with less down force wherein the protrusion amount prevents the wafer from effectively contacting the hard region.

In this manner, the wafer is polished using either the hard process effect or the soft process effect by selectively applying a predetermined amount of down force to the wafer. The hard process effect or the soft process effect is utilized for controlled amounts of time in order to achieve the customized polishing effect. By controlling the amount of down force applied and the length of time that down force is applied, the system of the present invention is readily tunable for each differing device being polished in the CMP process.

BRIEF DESCRIPTION OF THE DRAWINGS

The present invention is illustrated by way of example and not by way of limitation, in the figures of the accompanying drawings and in which like reference numerals refer to similar elements and in which.

Prior art

Prior art

Prior art

BEST MODE FOR CARRYING OUT THE INVENTION

A method and system for a patterned polishing pad for use in chemical mechanical polishing of semiconductor wafers. In the following description, for the purposes of explanation, numerous specific details are set forth in order to provide a thorough understanding of the present invention. It will be obvious, however, to one skilled in the art that the present invention may be practiced without these specific details. In other instances, well-known structures, devices, and processes are shown in block diagram form in order to avoid unnecessarily obscuring the present invention.

Chemical-mechanical polishing (CMP) is the preferred method of obtaining full planarization of a semiconductor wafer containing devices for fabrication processing. The CMP process involves removing all, or a portion of, a layer of dielectric material or metal using mechanical contact between the wafer and a moving polishing pad saturated with a polishing slurry. Polishing through the CMP process flattens out height differences, since high areas of topography (hills) are removed faster than areas of low topography (valleys). The CMP process has the capability of smoothing out topography over millimeter scale planarization distances, leading to maximum angles of much less than one degree after polishing.

The present invention comprises a patterned polishing pad for use in a CMP machine (or other wafer polishing machines). The present invention provides a readily optimized system for differing CMP process requirements. The system of the present invention is readily tunable for each differing device being polished in the CMP process. The system of the present invention is tailorable, depending upon the requirements of the particular devices being polished, without adversely impacting CMP process wafer throughput. Additionally, the system of the present invention has minimal added capital equipment costs, does not require increased fabrication facility floor space, and does not adversely impact operator training expenses. The present invention and its benefits are described in greater detail below.

Figure 1A:
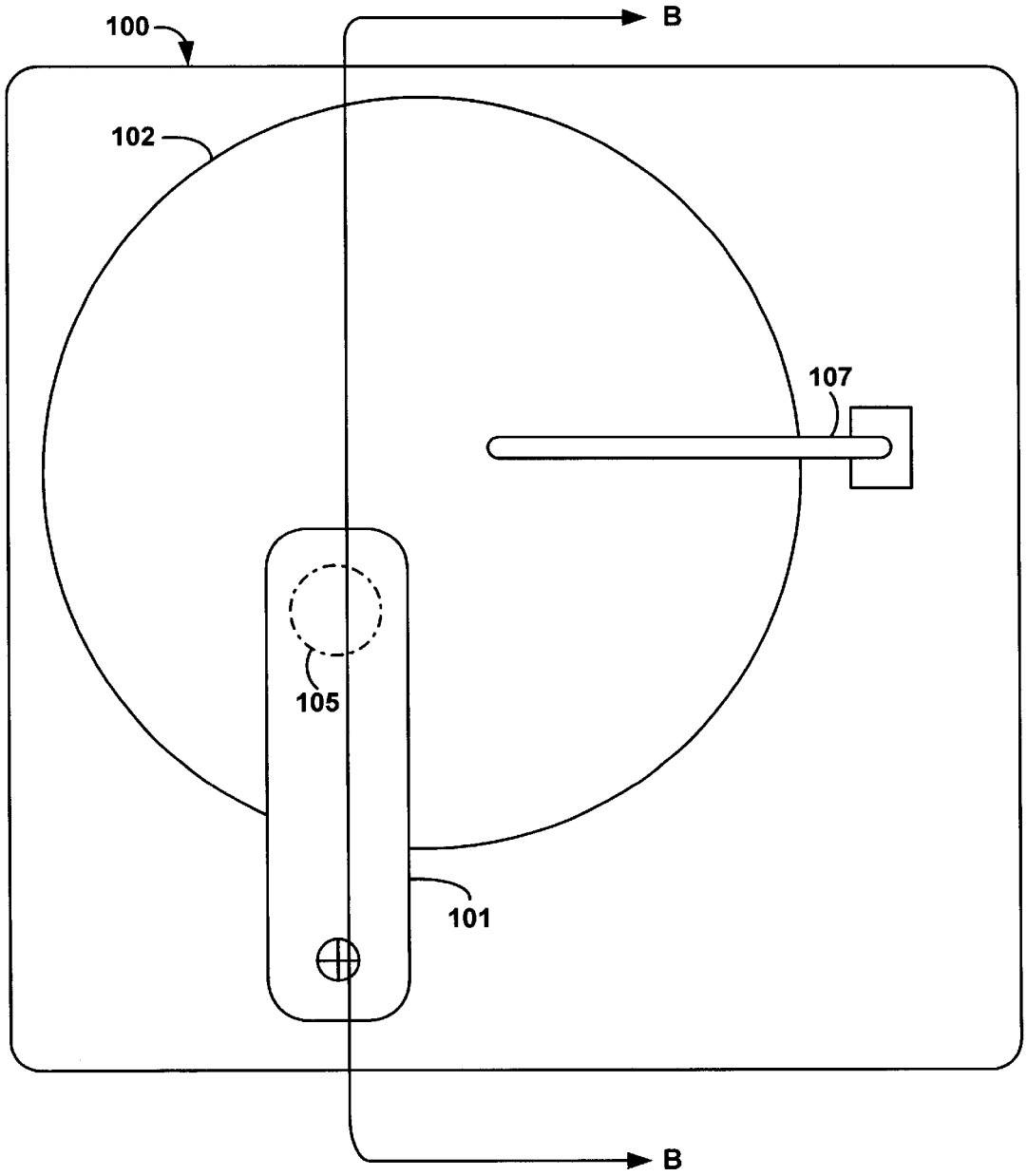
FIG. 1A (Prior Art)
FIG. 1A shows a top view of a prior art CMP machine.
Figure 1B:
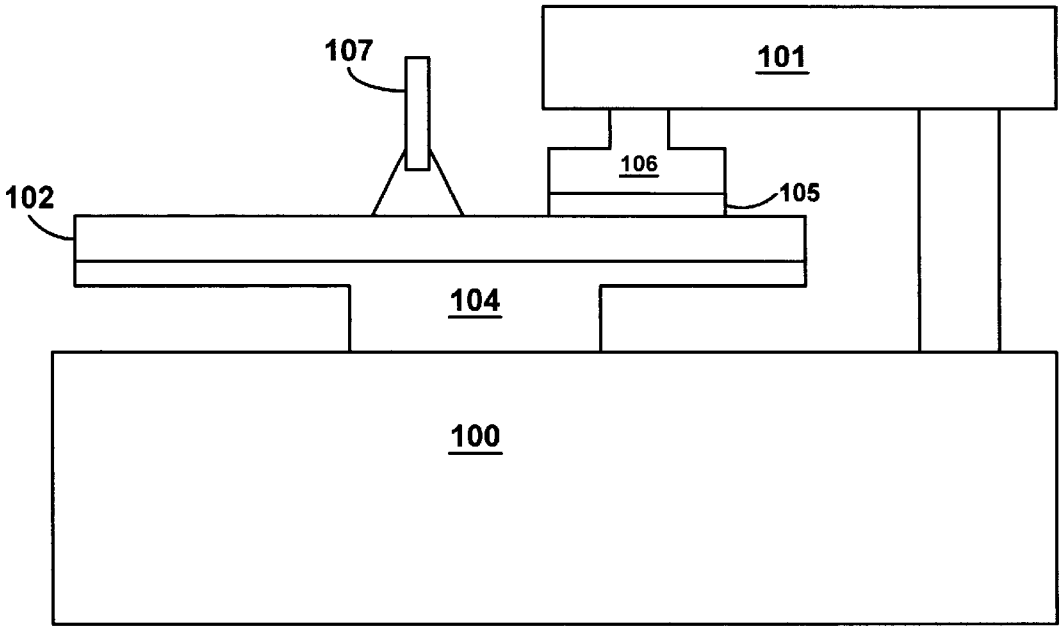
FIG. 1B (Prior Art)
FIG. 1B shows a side section view of the prior art CMP machine of FIG. 1A taken through line BB.
Figure 1C:
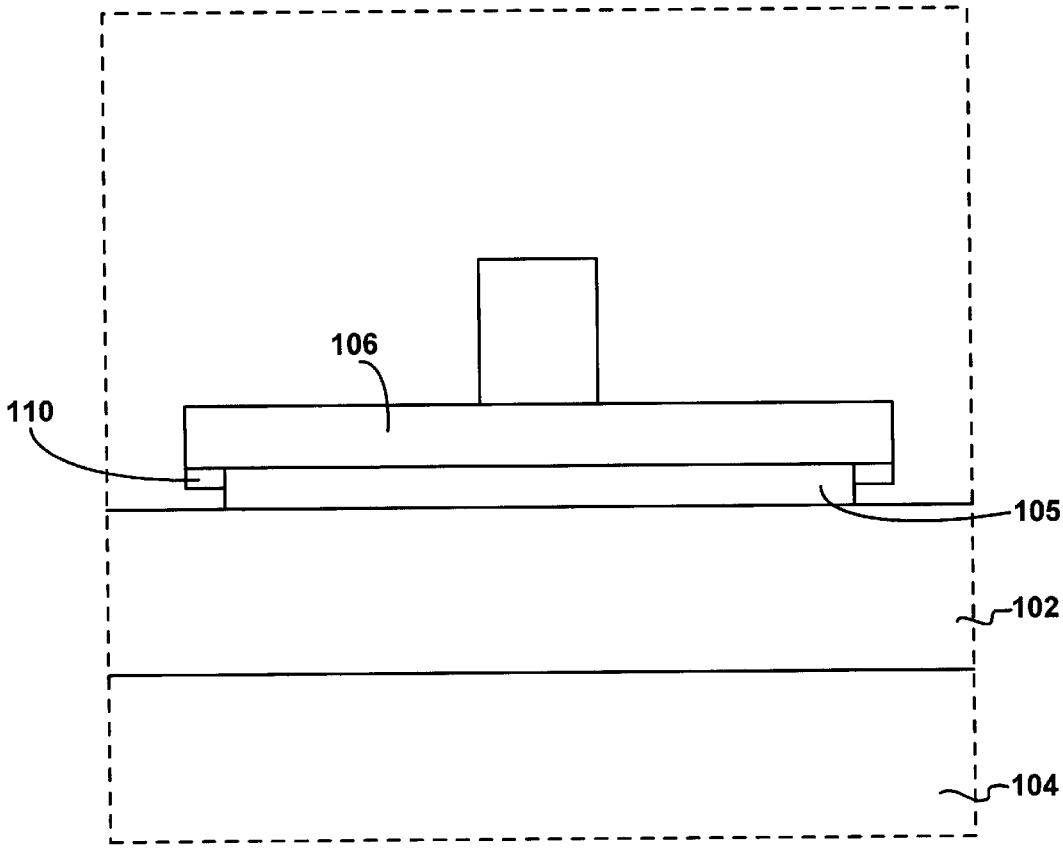
FIG. 1C (Prior Art)
FIG. 1C shows a close-up view of a wafer, a wafer carrier, and polishing pad as being used by the CMP machine of FIG. 1A and FIG. 1B.
Figure 2A:
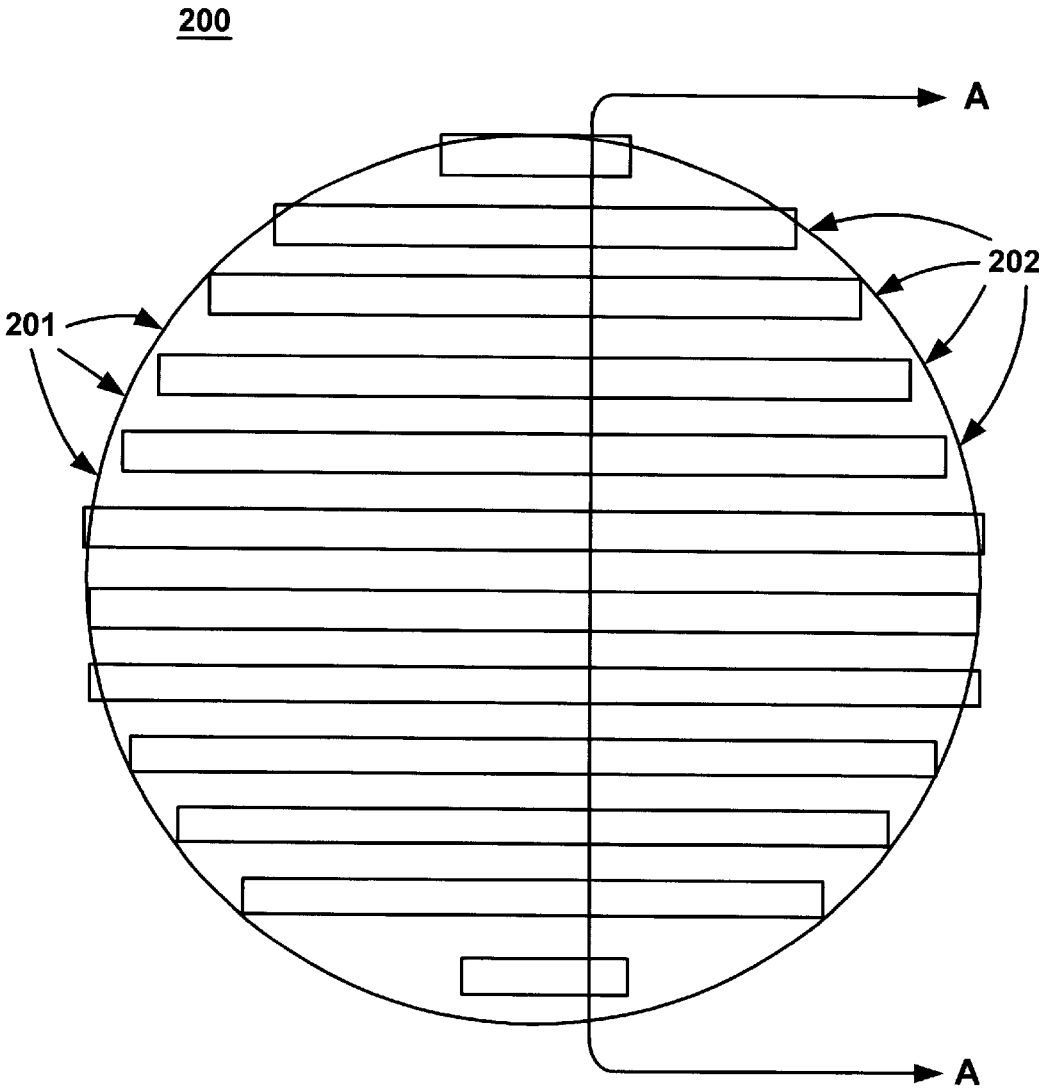
FIG. 2A shows a patterned polishing pad in accordance with one embodiment of the present invention.

Referring to FIG. 2A, a patterned polishing pad 200 in accordance with one embodiment of the present invention is shown. Customized polishing pad 200 includes a first region 201 and a second region 202 interleaved throughout the first region. The first region 201 and the second region 202 are both integral with the surface of the polishing pad 200 and, as depicted by FIG. 2A, are interleaved throughout the surface of polishing pad 200. The first region 201 and second region 202 each has differing polishing characteristics. In this embodiment, the first region 201 is a relatively firm, relatively hard polishing region, while the second region 202 is a relatively compressible, relatively soft polishing region.

Figure 2B:
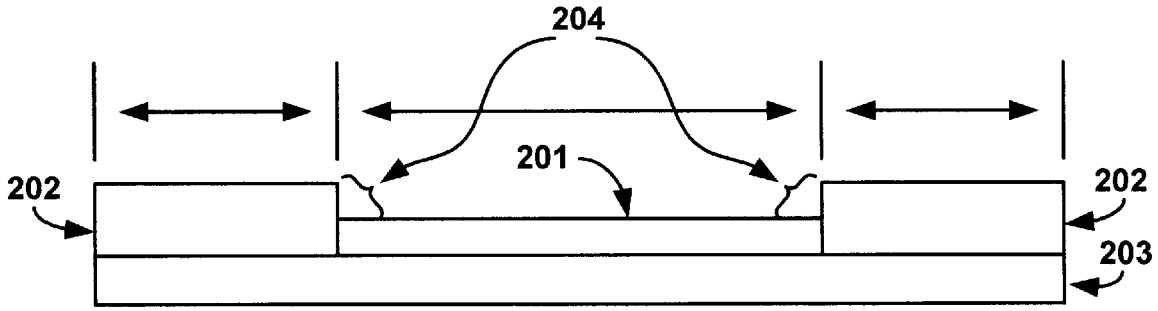
FIG. 2B shows a side section view of the patterned polishing pad of FIG. 2A taken through line AA.

With reference now to FIG. 2B, a side section view of a portion of customized polishing pad 200 through line AA is shown. In the present embodiment, the patterned polishing pad 200 includes an underlying region 203 beneath both the first region 201 and the second region 202. As depicted in FIG. 2B, the second region 202 (hereinafter referred to as the soft region 202) extends a predetermined amount above the surface of the first region 201 (hereinafter referred to as the hard region 201). Together, the surface of the soft region 202 and the surface of the hard region 201 collectively comprise the polishing surface exposed to semiconductor wafers being polished.

The soft region 202 is more compressible than the hard region 201. The soft region 202 extends a predetermined protrusion amount 204 above the surface of the hard region 201. By modulating the amount of down force applied to a wafer being polished, the polishing effect experienced by the wafer can be primarily a soft polishing effect from soft region 202 or primarily a hard polishing effect from hard region 201. When more down force is applied, soft region 202 compresses until the down force from the wafer is primarily opposed by the surface of hard region 201, thereby achieving a hard polishing effect. When less down force applied, soft region 202 is much less compressed such that the surface of the wafer does not effectively come in contact with the surface of hard region 201, thereby achieving a soft polishing effect.

In this manner, the wafer is polished using either the hard process effect or the soft process effect by selectively applying a predetermined amount of down force to the wafer. The hard process effect or the soft process effect is utilized for controlled amounts of time in order to achieve the customized polishing effect. By controlling the amount of down force applied and the length of time that down force is applied, the system of the present invention is readily tunable for each differing device being polished in the CMP process.

Referring still to FIGS. 2A and 2B, it should be noted that the patterned polishing pad 200 of the present invention effectively reduces the cycle time and the footprint of the polishing equipment, both of which are very critical in the manufacturing of IC device, especially for CMP processes which requires multiple steps of polish. Instead of requiring two separate polishing platens, one with a soft pad and the other with a hard pad (e.g., which often requires two separate CMP machines), a single polishing platen using a patterned polishing pad in accordance with the present invention can be used.

It should also be noted that the patterned polishing pad 200 can be plain or textured. The surface of hard region 201 can be textured differently than the surface of soft region 202. The major goal of texturing the pad surface is to optimize the slurry flow during CMP. Patterned polishing pad 200 can utilize differing text or patterns on the services of regions 201 and 202 such that polish and buff can be carried out on one CMP machine (e.g, one polishing platen).

Additionally, it should be noted that soft region 202 and hard region 201 can be combined without the use of an underlying region 203. In such an embodiment, the soft pad material is embedded directly into the hard pad material and held by the hard material with, for example, adhesive, thereby eliminating requirement for an underlying layer 203. For example, in such an embodiment, the hard pad material is grooved before placing stripes of the soft material. Alternatively, the hard and soft pads could be stitched together.

The width and the depth of the pattern of hard material and soft material can vary depending on requirements of the user's specific CMP process. In the embodiment shown in FIGS. 2A and 2B, stripes of the soft pad material (e.g., soft region 202) are shown in parallel swaths to each other to facilitate the production of this type of pad. As determined by manufacturing requirements, "slices" of soft pad material can also be placed radially outwards, similar to slices of a pizza. Texturing the soft pad also helps the removal of the polish slurry if the buff chemistry is different. Since both a soft polishing effect and the hard polishing effect are available on a single patterned polishing pad 200, the present invention offers the flexibility of utilizing multiple carriers with multiple wafers on a single CMP machine polishing platen.

Figure 3:
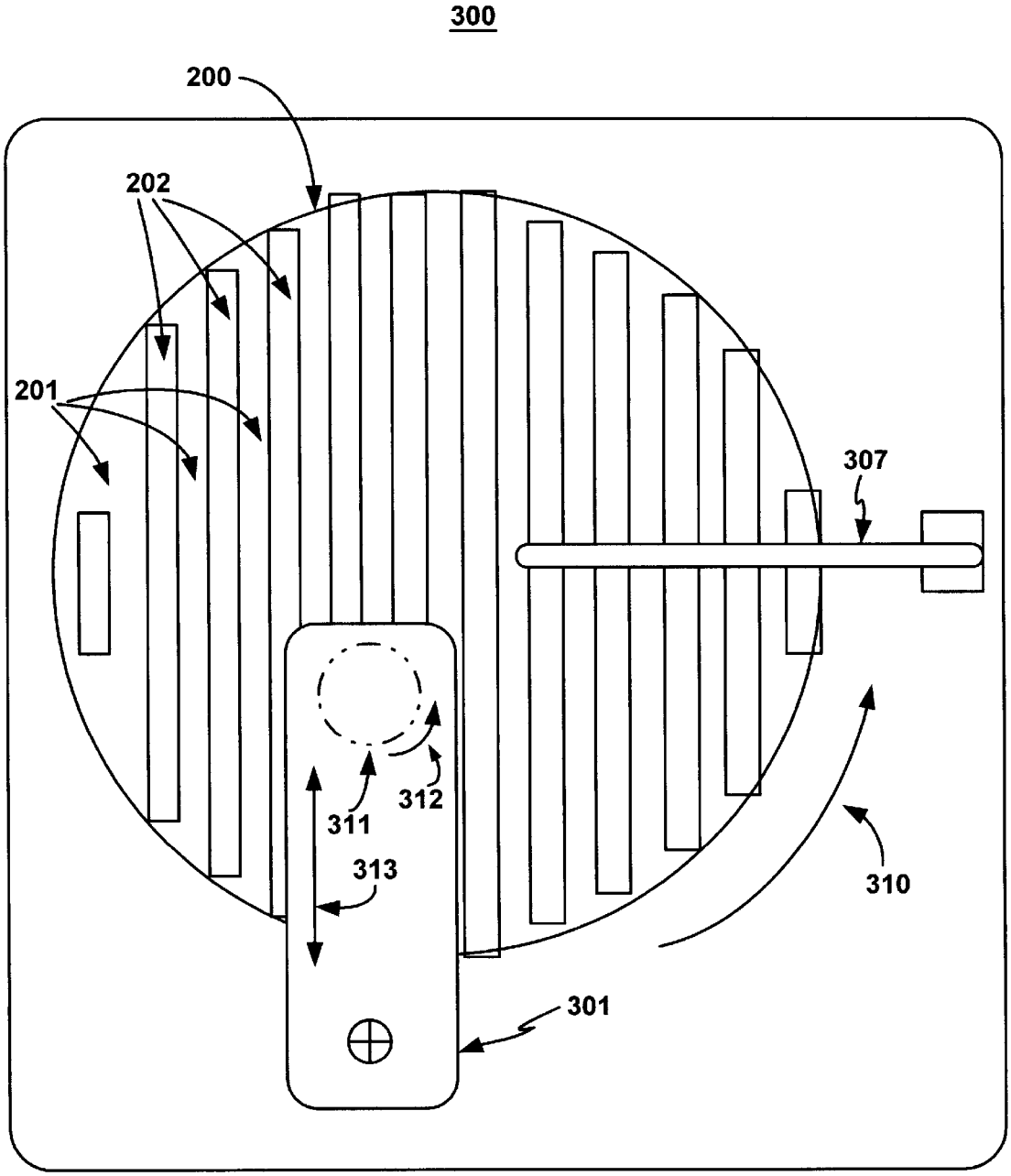
FIG. 3 shows a top view of a CMP machine using a patterned polishing pad in accordance with one embodiment of the present invention.

FIG. 3 shows a top view of a CMP machine 300 using the patterned polishing pad 200 in accordance with one embodiment of the present invention. The CMP machine 300 picks up wafers with an arm 301 and places them onto the rotating patterned polishing pad 200. The patterned polishing pad 200 rotates on a platen, located beneath patterned polishing pad 200, at a predetermined speed. The arm 301 forces a wafer 311 into the patterned polishing pad 200 with an appropriate amount of downward force as determined by the particular desired polishing effect. The lower surface of wafer 311 rests against patterned polishing pad 200. The upper surface of wafer 311 is against the wafer carrier of arm 301. As patterned polishing pad 200 rotates (as shown by arrow 310) arm 301 rotates wafer 311 at a predetermined rate (as shown by arrow 312). Simultaneously, arm 301 moves wafer 311 toward and away from the center of patterned polishing pad 200 (as shown by arrow 313). The CMP machine 300 also includes a slurry dispense arm 307 extending across the radius of patterned polishing pad 200. The slurry dispense arm 307 dispenses a flow of slurry onto patterned polishing pad 200.

The slurry is a mixture of de-ionized water and polishing agents designed to aid chemically the smooth and predictable planarization of the wafer. The rotating action of both patterned polishing pad 200 and wafer 311, in conjunction with the polishing action of the slurry, combine to planarize, or polish, wafer 311 at some nominal rate. This rate is referred to as the removal rate. A constant and predictable removal rate is important to the uniformity and throughput performance of the wafer fabrication process. The removal rate should be expedient, yet yield precisely planarized wafers, free from surface anomalies. If the removal rate is too slow, the number of planarized wafers produced in a given period of time decreases, hurting wafer throughput of the fabrication process. If the removal rate is too fast, the CMP planarization process will not be uniform across the surface of the wafers, hurting the yield of the fabrication process. Regions 201 and 202 of patterned polishing pad 200 of the present invention greatly aid the process of maintaining a stable and uniform removal rate.

The patterned polishing pad 200 of the present invention aids the process of maintaining a stable and uniform removal rate while polishing wafer 311 by selecting different polishing effects. The different polishing effects are used by CMP machine 300 to compensate for any non-uniform polishing characteristics present in the CMP process. CMP machine 300 selectively polishes wafer 311 using either the hard polishing effect or the soft polishing effect as described above such that the combined polishing action compensates for any non-uniform polishing characteristics.

For example, the CMP process often causes unstable removal rates due to the differing linear velocity of the edges of wafer 311 relative to the center. The differing linear velocity is due to the rotational movement of wafer 311 by CMP machine 300 during the polishing process. By selectively using the hard or soft polishing characteristics of patterned polishing pad 200, this differing linear velocity is compensated for.

In addition to the differing linear velocities, the hard or soft polishing effects of patterned polishing pad 200 can be used to compensate and adjust for additional variables present in the CMP process. An acceptable post-CMP surface of wafer 311 is obtained when enough oxide (or other surface layer material) has been removed such that the "hills" and "valleys" of the original topography are erased. Hills are removed more quickly than valleys since the removal rate is greater for higher structures on the surface of wafer 311 and less for lower structures.

During the CMP process, the amount of oxide removed needs to be closely controlled. If the removal rate is less than nominal, unwanted surface topography remains after polishing. If the removal rate is greater than nominal, wafer 311 may be left with excessively thin remaining inter-metal dielectric (IMD). The consequences of failing to meet proper planarity or uniformity requirements can be metal stringers or inter-metal layer shorts in the devices on the surface of wafer 311. In addition, inadequate surface layer thickness control can lead to excessive variation in the inter-layer capacitance, which in turn leads to circuit performance problems in the fabricated devices.

The quality of post-CMP process planarity is characterized in terms of step height ratio (SHR) and planarization distance (PD). SHR is zero for the case of perfect, long range planarization across the surface of wafer 311 and is one when there is no long range planarization. For example, SOG (Spin-on-glass) planarization, as opposed to CMP, only smoothes out local topography and does not create long range planarization; hence, it has an SHR close to one. The SHR of a CMP process can range from zero to one depending upon the polishing process, type of polishing pad, and the amount of material removed during polishing.

The PD is defined as the distance at which the post-polish step height of a "semi-infinite" step is realized. A long PD is desirable since variations in topography over areas that are much smaller than the PD will be completely planarized during polishing. The PD of a CMP process ranges from a few hundred microns to several millimeters across the surface of a wafer, depending upon the desired result.

The WID (within a die) uniformity largely depends upon the actual integrated circuit topography and the SHR and PD. For example, the remaining oxide thickness (or step height) is greater on wider integrated circuit structures, such as a wide metal pad, and is less on narrower integrated circuit structures, such as isolated narrow lines. The WID uniformity (and SHR after polish) also depend upon the density of the underlying topography of the integrated circuit. Areas with lower metal line density polish faster than areas with dense, underlying integrated circuit topography. Hence, with prior art CMP processing, each wafer having differing integrated circuits fabricated on its surface will have a slightly different WID non-uniformity due to variations in the size and density of its interconnects, metal lines, and other integrated circuit topography.

Thus, it should be noted that with respect to typical prior art CMP processes, a harder, less compressible polishing pad results in lower SHR and longer PD. This leads to improved WID thickness uniformity but less within a wafer (WIW) planarization uniformity. A softer, more compressible polishing pad yields higher SHR, and shorter PD. Hence, with prior art CMP processes, there is a trade off between improving WID uniformity and WIW uniformity.

Referring still to FIG. 3, the patterned polishing pad 200 of the present invention, however, readily optimizes the CMP process of CMP machine 300 for either improved WID uniformity or improved WIW uniformity. As described above, in the present embodiment, hard region 201 is comprised of a harder, less resilient material while soft region 202 is comprised of a softer, more resilient material. Thus, the amount of down force and time wafer 311 is polished is controlled by CMP machine 300 to yield the optimized degree of WID uniformity (e.g., a hard process effect) and the optimized degree of WIW uniformity (e.g., a soft process effect).

Hence, patterned polishing pad 200, by providing both a harder first region 201 and a softer second region 202, provides a system which is readily tunable for each differing device or each differing wafer being processed. By providing both optimized WID uniformity and optimized WIW uniformity on a single CMP machine (e.g., CMP machine 300), the patterned polishing pad 200 of the present invention does not adversely impact wafer throughput by requiring the use of multiple CMP processes on multiple CMP machines. Additionally, CMP processing in accordance with the present invention does not require the purchase of additional equipment (e.g., additional CMP machines with specific prior art polishing pads or a CMP machine with multiple polishing platens). Thus, fabrication facility floor space requirements are not increased, and operator training costs are not adversely impacted.

Figure 4A:
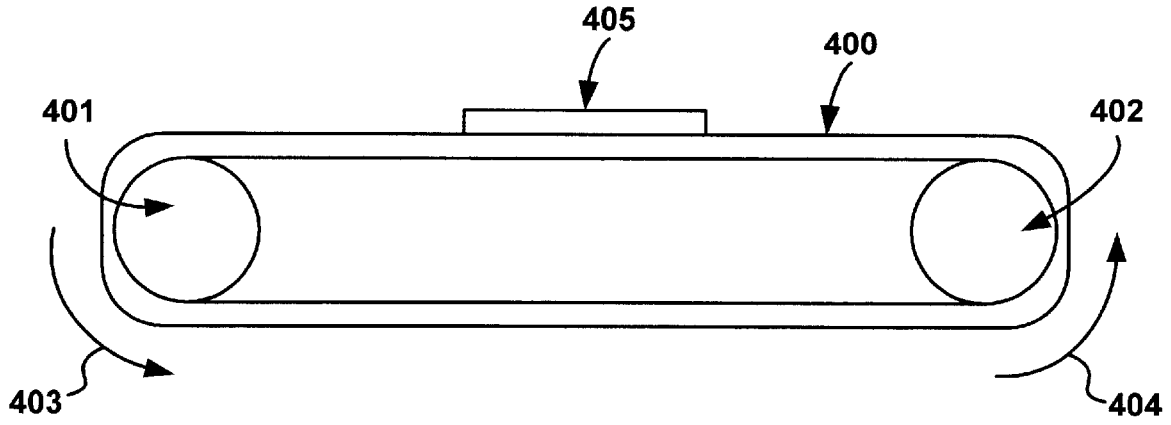
FIG. 4A shows a side view of a linear embodiment of the patterned polishing pad of the present invention.

Referring now to FIG. 4A, a side view of a patterned polishing pad 400 in accordance with another alternate embodiment of the present invention is shown. The patterned polishing pad 400 is used in a "linear" CMP machine as opposed to a "polar" CMP machine (e.g., CMP machine 300 of FIG. 3) or an "orbital" CMP machine. In the linear CMP machine, two rollers 401 and 402 continuously move patterned polishing pad 400 in the manner shown by arrows 403 and 404. A wafer 405 is held against patterned polishing pad 400 for polishing. The linear CMP machine functions similarly to the polar CMP machine except for the nature of the movement of patterned polishing pad 400.

Figure 4B:
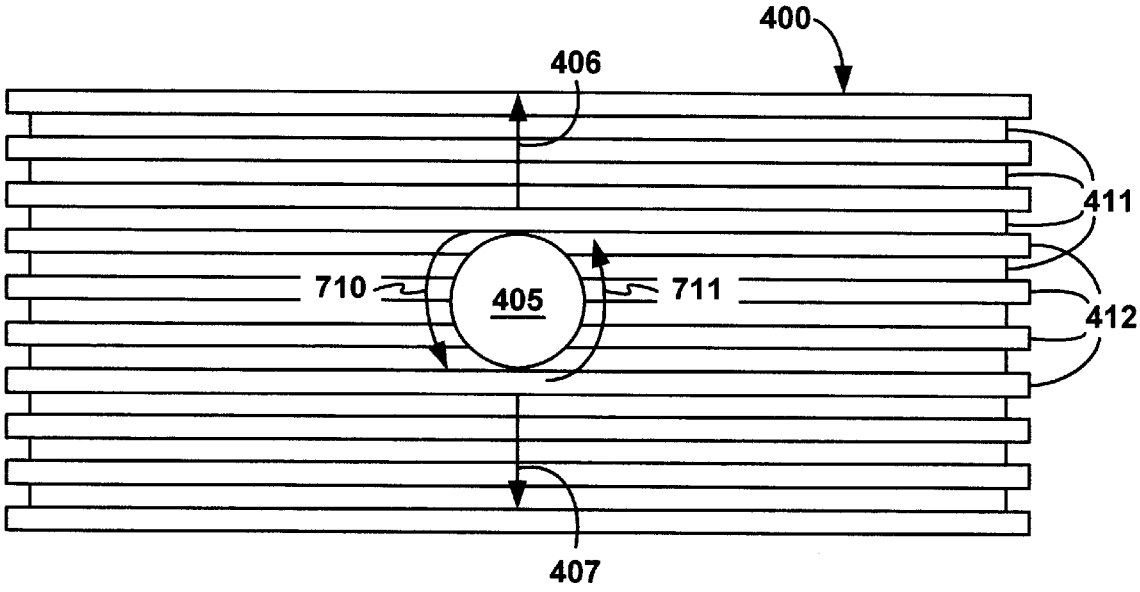
FIG. 4B shows a top view of the patterned polishing pad from FIG. 4A.

Referring now to FIG. 4B, a top view of patterned polishing pad 400 is shown. Patterned polishing pad 400 moves with respect to wafer 405 as shown by arrows 706 and 707. Wafer 705 is translated across patterned polishing pad 700 by the linear CMP machine, in the manner shown by arrows 708 and 709, and is continually rotated as shown by arrows 710 and 711. As with polishing pad 200 of FIG. 2A, polishing pad 400 includes a of hard region 411 and interleaved soft region 412. Thus, it should be appreciated that the present invention is well suited to use in linear, polar, or orbital CMP machines.

Figure 5:
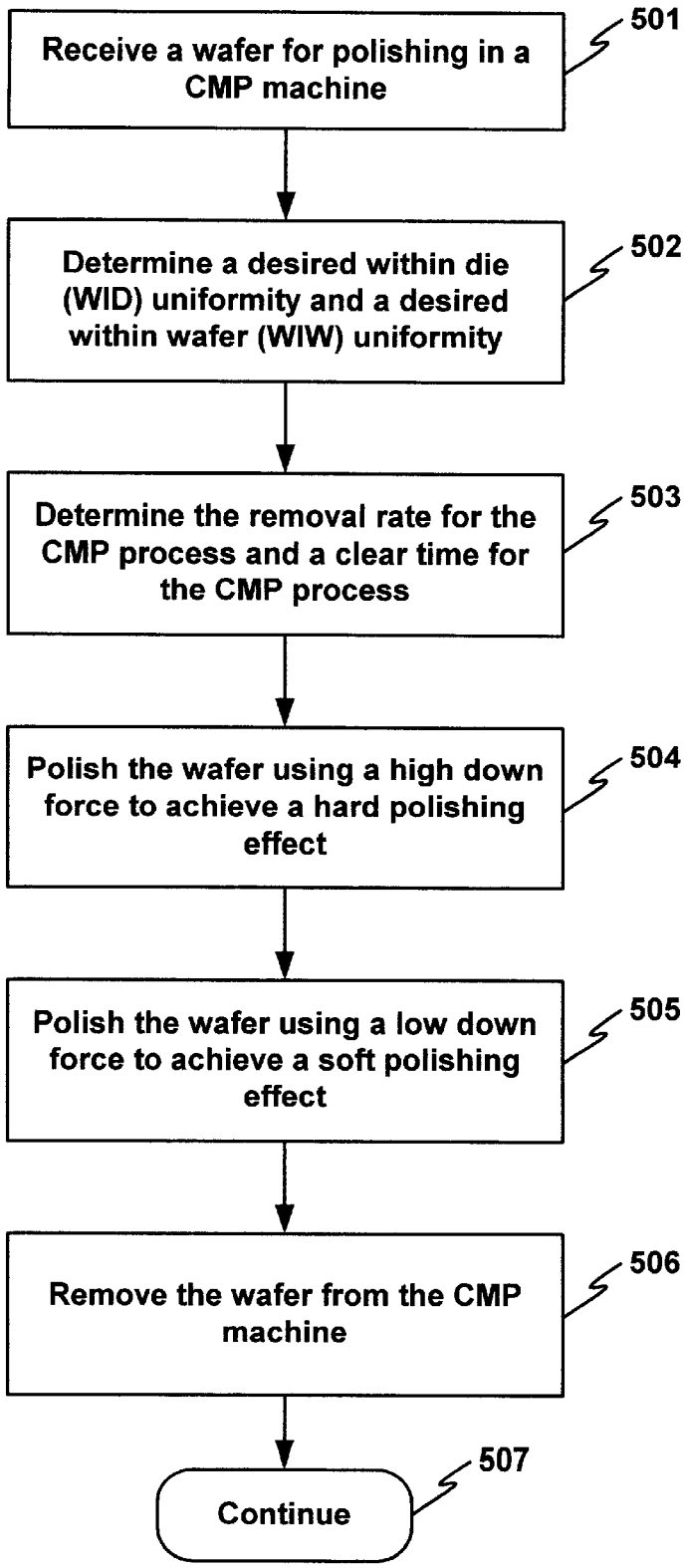
FIG. 5 is a flowchart of the steps of a process in accordance with one embodiment of the present invention.

With reference now to FIG. 5, a flowchart 500 of the steps performed in accordance with one embodiment of the present invention is shown. As depicted in FIG. 5, process 500 shows the wafer polishing steps of a CMP machine (e.g., CMP machine 300 of FIG. 3) having a patterned polishing pad (e.g., patterned polishing pad 200 of FIGS. 2A and 2B) in accordance with the present invention.

In step 501, a CMP machine having a patterned polishing pad in accordance with the present invention receives a wafer to be polished. The CMP machine polishes wafers as part of an overall wafer fabrication process. Each wafer received for polishing includes a plurality of integrated circuit devices being fabricated on the wafer surface and is being polished to facilitate subsequent photolithography process steps.

In step 502, the optimal WID and WIW uniformity for the particular wafer being polished is determined. WID uniformity depends upon the actual integrated circuit topography of the devices on the surface of the particular wafer. For example, areas with lower metal line density polish faster than areas with dense metal line topography. Thus, the desired WID and WIW uniformity varies with the types of devices on the wafer.

In step 503, the removal rate for the CMP process and the clear time for the process are determined. As described above, the removal rate is a measure of the rate at which material (dielectric or metal) is removed from the surface of the wafer by the CMP processing (e.g., using the hard down force). The clear time refers to the time at which the CMP processing of the wafer will have removed to correct amount of layer material, for example, "clearing" the material from the underlying layer, or clearing topography from the surface. The removal rate and the clear time allow the subsequent determination of the amount of time CMP is performed with the high down force and the amount of time CMP is performed with the low down force.

In step 504, once the optimal WID and WIW uniformity is determined, along with the removal rate and the clear time, the wafer is polished using a relatively high down force to achieve a hard polishing effect. As described above, the high down force compresses the soft region (e.g., soft region 202) of the patterned polishing pad such that the hard region (e.g., hard region 201) provides the primary polishing effect. As described above, the hard polishing effect is designed to achieve a specific WIW uniformity.

In step 505, the wafer is polished using a relatively low down force to achieve a soft polishing effect. As described above, the low down force allows the protruding soft region 202 to support the wafer such that soft region 202 provides the primary polishing effect. As described above, the soft polishing effect is designed to achieve a specific WID uniformity. Thus, the amount of time the wafer is polished using the high down force and the amount of time the wafer is polished using the low down force is controlled by the CMP machine to yield the optimized degree of WID uniformity and the optimized degree of WIW uniformity.

In step 506, the wafer is removed from the CMP machine. The wafer has been planarized to the optimal degree WID and WIW uniformity by the patterned polishing pad of the present invention and is ready for the subsequent lithography steps in the fabrication process.

Hence, in step 507, process 500 continues as the CMP machine is now ready to accept a subsequent wafer for CMP polishing. Because of the CMP machine uses the patterned polishing pad of the present invention, the subsequent wafer will be optimally polished even if it contains integrated circuit devices having different topography and different metal line density in comparison to the previous wafer. Hence, the patterned polishing pad of the present invention, by providing both a first region having a first hardness and a second region having a second hardness, provides a system which is readily tunable for each differing device on each differing wafer being processed. Although only two regions are recited in the steps of flowchart 500, the present method is also well suited to use with a patterned polishing pad having a greater number of regions and/or specific textures per region.

Thus, the present invention provides a readily optimized system for differing CMP process requirements. The system of the present invention is readily tunable for each differing device being polished in the CMP process. The system of the present invention is tailorable, depending upon the requirements of the particular devices being polished, without adversely impacting CMP process wafer throughput. Additionally, the system of the present invention has minimal added capital equipment costs, does not require increased fabrication facility floor space, and does not adversely impact operator training expenses.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order best to explain the principles of the invention and its practical application, thereby to enable others skilled in the art best to utilize the invention and various embodiments with various modifications as are suited to the particular use contemplated. It is intended that the scope of the invention be defined by the Claims appended hereto and their equivalents.

What is claimed is:

1. A patterned polishing pad adapted for use in a chemical mechanical wafer polishing machine, the patterned polishing pad comprising:

a polishing pad adapted for use on a polishing platen in a chemical mechanical wafer polishing machine;

a polishing surface included in the polishing pad, the polishing surface adapted to frictionally contact a wafer in the wafer polishing machine;

a first region of the polishing surface, the first region adapted to frictionally contact the semiconductor wafer to achieve a first process effect; and a second region of the polishing surface, the second region adapted to frictionally contact the semiconductor wafer to achieve a second process effect, the second region extending a predetermined protrusion amount above the polishing surface with respect to the first region such that the wafer polishing machine achieves a customized process effect by:

moving the semiconductor wafer frictionally against the first region with a down force operable for compressing the protrusion amount of the second region; and moving the semiconductor wafer frictionally against the second region wherein the protrusion amount prevents the semiconductor wafer from effectively contacting the first region.

2. The patterned polishing pad of claim 1 wherein the first region is less compressible than the second region.

3. The patterned polishing pad of claim 1 wherein the first region is adapted to achieve a hard polishing effect on the surface of the semiconductor wafer and the second region is adapted to achieve a soft polishing effect on the surface of the semiconductor wafer.

4. The patterned polishing pad of claim 1 wherein the second region is more compressible than the first region such that the first process effect is achieved by applying a first down force to the semiconductor wafer operable to compress the second region such that the semiconductor wafer frictionally contacts the first region.

5. The patterned polishing pad of claim 4 wherein the second region extends the predetermined amount above the first region such that the second process effect is achieved by applying a second down force to the semiconductor wafer, the second down force being less than the first down force, such that the surface of the semiconductor wafer frictionally contacts the second region while the protrusion amount prevents the surface of the semiconductor wafer from effectively contacting the first region.

6. The patterned polishing pad of claim 1 wherein the first region has a first texture configured to facilitate the first process effect and the surface of the second region has a second texture configured to achieve the second process effect.

7. The patterned polishing pad of claim 1 wherein the second region is disposed in an interleaved fashion with respect to the first region of the polishing pad.

8. The patterned polishing pad of claim 1 wherein the patterned polishing pad is a circular pad adapted for use on an orbital chemical mechanical polishing machine.

9. The patterned polishing pad of claim 1 wherein the patterned polishing pad is a linear polishing pad adapted for use on a linear chemical mechanical polishing machine.

10. In a chemical mechanical polishing machine for polishing semiconductor wafers, a patterned polishing pad adapted for use in the chemical mechanical polishing machine, the patterned polishing pad comprising:

a polishing pad adapted for use on a polishing platen in a wafer polishing machine;

a polishing surface included in the polishing pad, the polishing surface adapted to frictionally contact a wafer in the wafer polishing machine;

a first region of the polishing surface, the first region adapted to frictionally contact the semiconductor wafer to achieve a first process effect; and a second region of the polishing surface, the second region adapted to frictionally contact the semiconductor wafer to achieve a second process effect, the second region being more compressible than the first region, the second region extending a predetermined protrusion amount above the polishing surface with respect to the first region such that the wafer polishing machine achieves a customized process effect by:

moving the semiconductor wafer frictionally against the first region with a first down force directed against the semiconductor wafer operable for compressing the protrusion amount of the second region; and moving the semiconductor wafer frictionally against the second region with a second down force directed against the semiconductor wafer, the second down force being less than the first down force such that the protrusion amount prevents the semiconductor wafer from effectively contacting the first region.

11. The patterned polishing pad of claim 10 wherein the first region is adapted to achieve a hard polishing effect on the surface of the semiconductor wafer and the second region is adapted to achieve a soft polishing effect on the surface of the semiconductor wafer.

12. The patterned polishing pad of claim 10 wherein the second region is more compressible than the first region such that the first process effect is achieved by applying a first down force to the semiconductor wafer operable to compress the second region such that the semiconductor wafer frictionally contacts the first region.

13. The patterned polishing pad of claim 12 wherein the second region extends the predetermined amount above the first region such that the second process effect is achieved by applying a second down force to the semiconductor wafer, the second down force being less than the first down force, such that the surface of the semiconductor wafer frictionally contacts the second region while the protrusion amount prevents the surface of the semiconductor wafer from effectively contacting the first region.

14. The patterned polishing pad of claim 10 wherein the first region has a first texture configured to facilitate the first process effect and the second region has a second texture configured to achieve the second process effect.

15. The patterned polishing pad of claim 10 wherein the second region is disposed in an interleaved fashion with respect to the first region of the polishing pad.

16. The patterned polishing pad of claim 10 wherein:

the first down force is applied to the semiconductor wafer to achieve the first process effect, the first process effect being operable to improve within die uniformity; and the second down force is applied to the semiconductor wafer to achieve the second process effect, the second process effect being operable to improve within wafer uniformity.

* * * * *